US007966798B2

(12) United States Patent
Van Rooij

(10) Patent No.: US 7,966,798 B2
(45) Date of Patent: Jun. 28, 2011

(54) DEVICE FOR STRETCHING A TRANSMISSION CHAIN

(75) Inventor: Jacobus Hubertus Maria Van Rooij, Nuenen (NL)

(73) Assignee: Gear Chain Industrial B.V., Nuenen (NL)

( * ) Notice: Subject to any disclaimer, the term of this patent is extended or adjusted under 35 U.S.C. 154(b) by 240 days.

(21) Appl. No.: 12/318,337

(22) Filed: Dec. 24, 2008

(65) Prior Publication Data

US 2009/0126334 A1 May 21, 2009

(30) Foreign Application Priority Data

Jan. 2, 2007 (NL) ..... 1034882

(51) Int. Cl.
*F16G 5/18* (2006.01)

(52) U.S. Cl. ..... 59/35.1; 59/8; 59/29; 474/201; 474/219; 474/220; 474/245

(58) Field of Classification Search ..... 474/167, 474/201, 206, 213, 214, 215, 219, 220, 226, 474/228, 229, 230, 242, 344, 245; 59/7, 59/8, 15, 29, 35.1, 90, 91
See application file for complete search history.

(56) References Cited

U.S. PATENT DOCUMENTS

| | | | | |
|---|---|---|---|---|
| 1,255,912 | A | | 2/1918 | Morse |
| 1,419,156 | A | | 6/1922 | Leyner |
| 1,966,831 | A | | 7/1934 | Oakes et al. |
| 3,043,154 | A | | 2/1961 | Karig et al. |
| 4,201,367 | A | * | 5/1980 | Konen, Sr. ..... 254/231 |
| 4,337,057 | A | | 6/1982 | Horowitz et al. |
| 4,515,576 | A | | 5/1985 | Wiens |
| 4,531,926 | A | | 7/1985 | Reeves, Jr. |
| 4,571,218 | A | | 2/1986 | Reeves, Jr. |
| 5,690,571 | A | | 11/1997 | Mott |

(Continued)

FOREIGN PATENT DOCUMENTS

EP 0741255 A1 11/1996

(Continued)

OTHER PUBLICATIONS

Van Otto Dittrick, Bed Homburg v.d.H., "Ein Stufenloses Hochleistungsgetriebe Mit 'Stahlriemen'", VDI-Zeitschrift 108, Feb. 1966, 227-232.

*Primary Examiner* — David B Jones
(74) *Attorney, Agent, or Firm* — Duane Morris LLP

(57) ABSTRACT

Device for stretching a transmission chain closed in itself and comprising pairs of elongated rocker elements mutually coupled by links, said rocker elements being destined for a torque transferring cooperation with the pulley sheaves of a pulley sheave transmission, and comprising a first and a second supporting surface which support a chain to be treated over an angle of an arc and having an adjustable mutual distance to generate tensile stresses in the chain supported thereby, in which the first supporting surface is freely rotatable accommodated between the first ends of two distant frame parts, the second supporting surface is freely rotatable accommodated on an auxiliary carrier between the two frame parts, said carrier being provided with two opposite stubby shafts, protruding there from and of which the axis lies at a distance from the axis of rotation of the second supporting surface which is rotatably supported by said auxiliary carrier and lies near the second end of the frame parts while of said supporting surfaces at least one can be driven in rotation.

10 Claims, 4 Drawing Sheets

U.S. PATENT DOCUMENTS

| | | | | |
|---|---|---|---|---|
| 5,728,021 | A | 3/1998 | Van Rooij et al. | |
| 6,558,281 | B1 * | 5/2003 | Greiter | 474/219 |
| 6,676,552 | B2 * | 1/2004 | Scheufele et al. | 474/215 |
| 6,824,484 | B2 | 11/2004 | Greiter | |
| 7,320,656 | B2 | 1/2008 | Linnenbrugger et al. | |
| 2002/0068654 | A1 | 6/2002 | Baumann et al. | |
| 2003/0017896 | A1 | 1/2003 | Markley et al. | |
| 2003/0036450 | A1 | 2/2003 | Linnenbrugger et al. | |
| 2003/0186767 | A1 | 10/2003 | Greiter | |
| 2006/0030442 | A1 | 2/2006 | Hubertus Maria van Rooij et al. | |

FOREIGN PATENT DOCUMENTS

| | | | |
|---|---|---|---|
| EP | 1721686 | A1 | 11/2006 |
| JP | 2007-167931 | A | 7/2007 |
| NL | 1018597 | C2 | 7/2001 |
| NL | 1029042 | C2 | 11/2006 |

* cited by examiner

DEVICE FOR STRETCHING A TRANSMISSION CHAIN

The invention relates to a device for stretching a transmission chain which is closed in itself and comprises a number of adjacent links which are, as seen in the longitudinal direction of the chain mutually coupled by pairs of elongated rocker elements in which each pair of the ends of at least one rocker element cooperate in a torque transferring way with the pulley sheaves of a pulley sheave transmission, and comprising a first and a second supporting surface which each support a chain to be stretched over a part of an arc and of which the mutual distance is adjustable in such a way that in a chain which supported thereby such tensile stresses can be generated that the limit of elasticity of the material of the links is exceeded at least locally.

Such a device is known from NL 1 029 042 (in the name of applicant) and from the not pre-published Dutch patent application NL 1 032 385 (also in the name of applicant). The known process of increasing the strength of a transmission chain by means of stretching same is explained in these documents.

The invention aims to provide a device of this kind with a very simple stable and rigid structure by means of which, this stretching of a transmission chain can be effected quickly and reliably, and in which particularly the fitting of a transmission chain around the supporting surfaces thereof can be effected quickly and securely so that with a limited number of simple devices of this kind a great number of chains can be treated within a short time period.

This aim is obtained in accordance with the invention in that the first supporting surface is freely rotatable accommodated between the first ends of two frame parts which lie at a distance from each other, the second supporting surface is freely rotatable around an auxiliary carrier accommodated between these frame parts and this auxiliary carrier is supported by two stubby shafts, each protruding at a surface thereof, the axis of said shafts lying at a distance from the axis of rotation of said second supporting surface, said stubby shafts being rotatable supported between the frame parts near the second end thereof while at least one of said shafts is coupled to the auxiliary carrier and can be driven in rotation.

The stretching of a chain is brought about by a-limited-rotation of the stubby shafts with as a result that, as a consequence of the eccentrical position thereof, the distance between the two supporting surfaces increases. The tensile stresses generated in the chain generate only pressure stresses in both the frame parts and it will be clear that such stresses can be easily accommodated by said frame parts. A great advantage of the device according to the invention is furthermore that in the position of the supporting surfaces in which their mutual distance is minimal, a chain which is to be treated can be fitted easily and quickly over these supporting surfaces whereafter the stretching is effected by a rotation of the auxiliary carrier, starting from the position with minimal mutual distance, and the tensile stresses generated in the chain depend on the angle over which the auxiliary carrier is rotated.

The supporting surfaces can be such that they support the radial inner carrier of at least a part of the chain, but they can also have the shape of conical surfaces upon which the ends of the torque transmitting locker pins bear.

Various embodiments of the present disclosure are described below. In one embodiment, the diameter of the second support is at least 2-2½ times larger than same of the first support. In another embodiment, the means are provided for rotatingly driving the first support. For example the means can be a driving motor having a selectable rotational speed. In another embodiment, the drive of the auxiliary carrier may include a torque meter. In yet another embodiment, means are provided to determine the angular position of the auxiliary carrier and for indicating and/or storing the torque with which this carrier is driven as a function of the registered angular position thereof.

It is observed that the principle of varying the distance between the respective centre lines of two subjects by means of eccentricity is known in itself, as documented by FR 993 686. This document gives a number of examples of the way in which by means of an eccentric mounting of the housing of a starter motor in a disk-shaped support the distance of the wheel on the shaft of this motor to a second stationary wheel, to be driven by this first wheel by means of a belt, can be adjusted to tension the belt. The present disclosure as outlined above, however, proposes a specific structure with a simple frame comprising two parallel plates which carries two supporting elements for a very specific purpose—the stretching of a transmission chain fitted around these elements. This stretching generates considerable tensile forces between these elements which are as a result of the proposed structure easily accommodated in the plates as compressive forces while retaining the possibility of an easy adjustment of the distance between the supporting elements. This is certainly novel and not obvious at all after what is considered to be known from said document.

DETAILED DESCRIPTION

Figure 2:
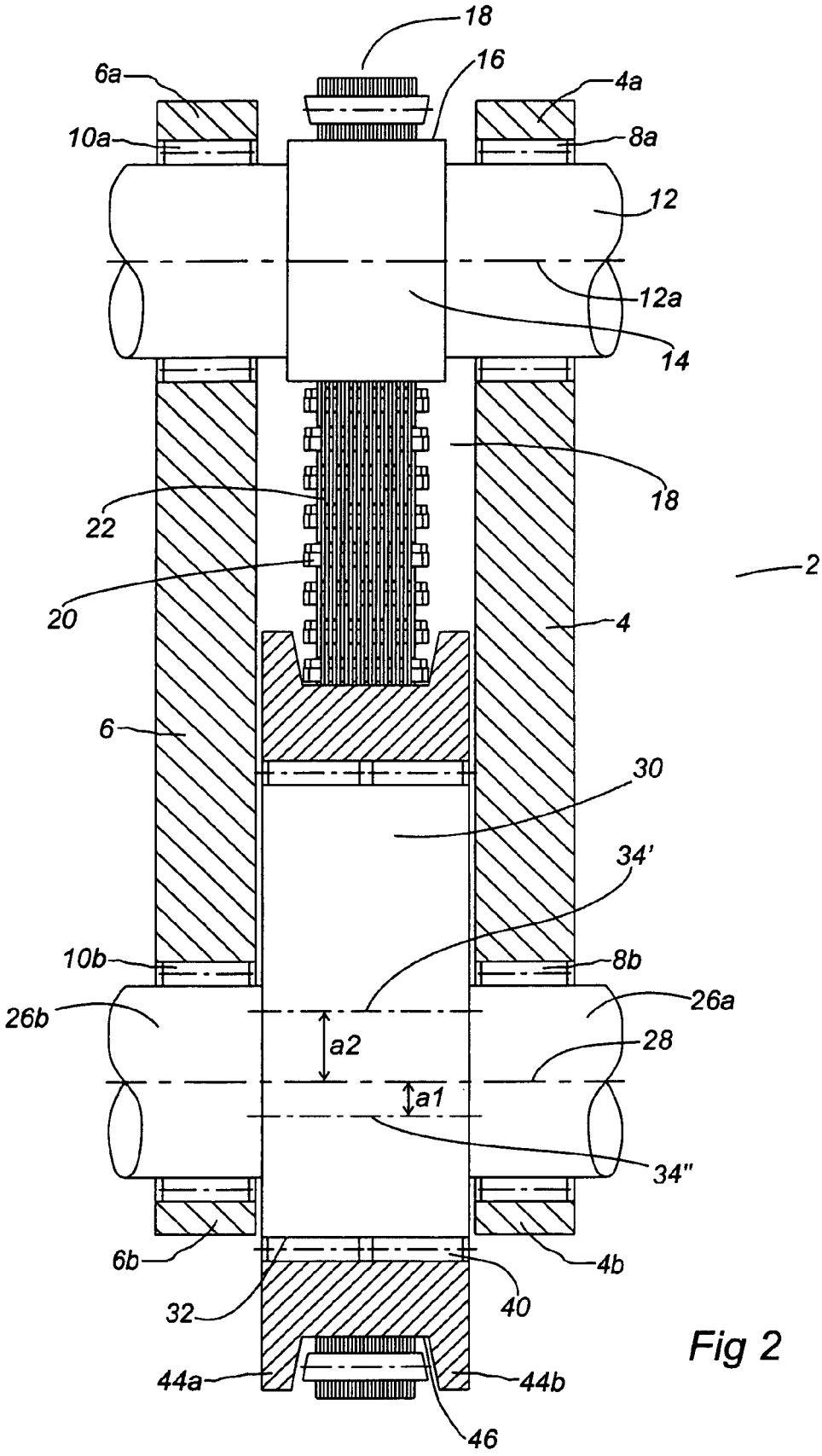
FIG. 2 is a horizontal cross-section, perpendicular to the plane of the drawing, of the embodiment of FIG. 1 with the various parts in the position in which the fitted chain is stretched.

In FIG. 2 one embodiment is indicated in its whole with reference numeral 2. This device comprises two equal, elongated and mutual parallel frame parts 4 and 6 which each support near the ends 4*a*, 4*b* and 6*a*, 6*b* respectively a roller bearing 8*a*, 8*b* and 10*a*, 10*b* respectively. The roller bearings 8*a*, 10*a* support a first shaft with a central part 14 of enlarged diameter; the cylindrical outer surface 16 of this central part is the first supporting surface for a transmission chain which is to be treated in the device 2 and which chain is in its entirety indicated with reference numeral 18. This transmission chain is, as is known in itself, constituted by pairs of rocker elements 20 mutually coupled by links 22, such as known from EP 0 741 255 in the name of applicant.

The bearings 8*b*, 10*b* each support a stubby shaft 26*a*, 26*b* respectively with common axis 28. Fixed to these stubby shafts 26*a*, 26*b* is a circle disk shaped auxiliary carrier 30 with cylindrical outer surface 32 and; the outer surface 32 of this auxiliary carrier 30 supports, by means of a number of bearing rollers 40, freely rotatable a supporting wheel 42 with the two end flanges 44*a*, 44*b* and the surface 46 there between which constitutes the second supporting surface. Of course one can also use a single through going shaft of which the central part is in a suitable way (for instance by having a non cylindrical configuration or by means of a spline connection) coupled with the auxiliary carrier.

Figure 1:
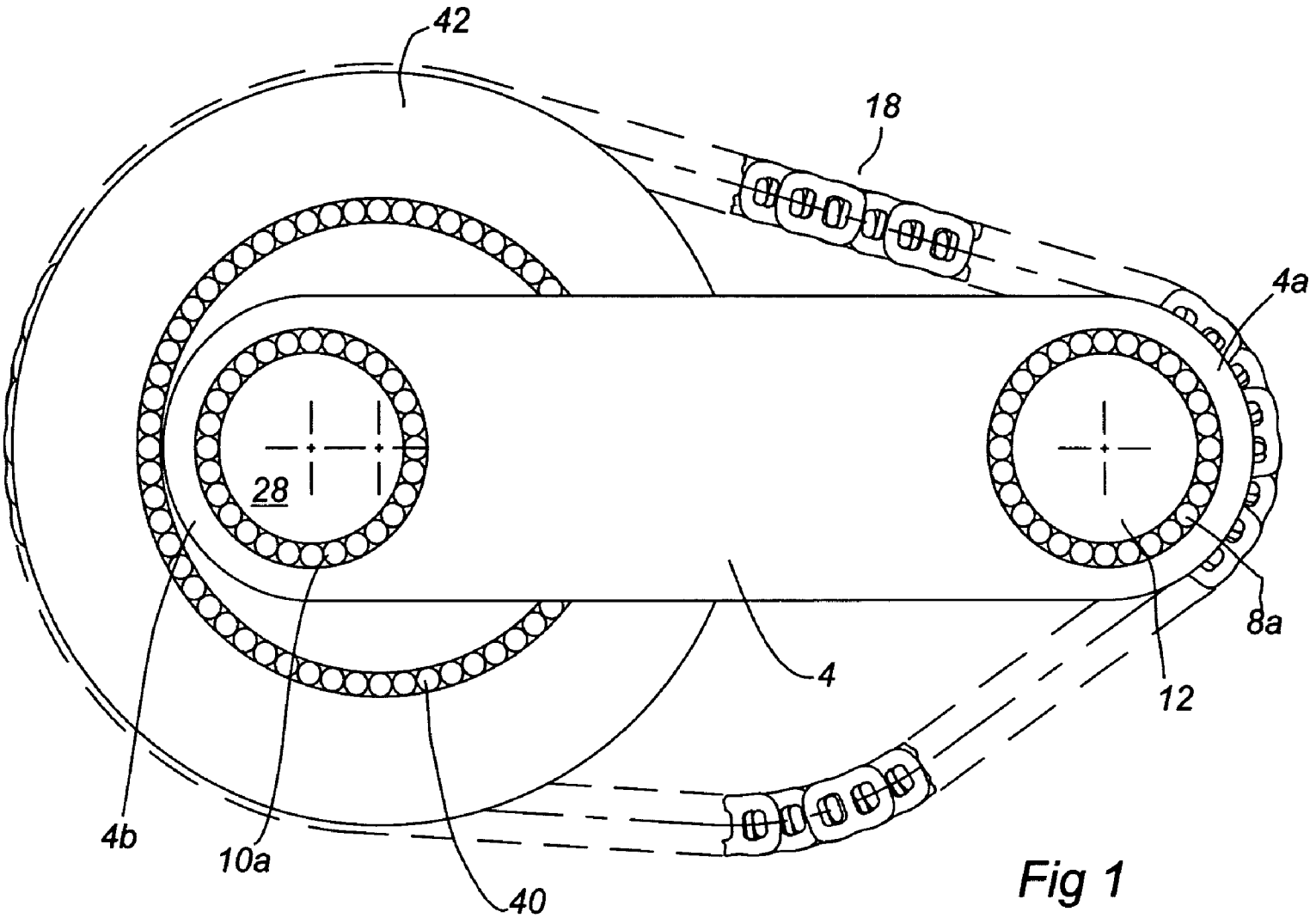
FIG. 1 is a side view, partly in cross-section, of an embodiment of the present disclosure in the state in which a chain to be stretched can be fitted.

The axis of this auxiliary carrier which is also the axis of rotation of the supporting wheel 42 is in FIG. 2 indicated with 34. In the position of the parts as shown in FIG. 1 a chain 18 which is to be treated can be fitted.

The drawings illustrate the stretching of a transmission chain in which the inner edges of the links 22 bear on the supporting surfaces 16 and 32 respectively, such as described in the not pre-published patent application 1 032 385 in the name of applicant. Of course also an embodiment is possible in which one or both supports have conical supporting edges on which the ends of the rocker pins of a chain which is to be treated bear.

The device is operated as follows. In the state without chain, the auxiliary carrier 30 is brought in a position in which the axis 34 (which is the axis of rotation of the supporting wheel 42) has the position as shown in FIG. 1 and thus lies in the plane of drawing of FIG. 2, is indicated with 34' in FIG. 2, and thus lies at the distance a2 above the axis 28. Then the distance between the first supporting surface 16 and the second supporting surface 46 is minimal.

Because this distance between the first and second supporting surface is at a minimum, a chain to be stretched can be easily shifted over one of the edges 4*a* or 6*a* respectively of a frame part on the one hand and over a flange 44*a*, 44*b* respectively on the other hand and thus then assumes the position as shown in FIG. 2. By rotating the stubby shafts 26*a*-26*b* the distance between the supporting surfaces is increased as a result of the eccentrical support of the auxiliary carrier 30, until the chain is under tension and is stretched. During this movement, the axis 34 describes a curve around the axis 28. The treatment is ended when the projection of the axis 34 on the plane of the drawing of FIG. 2 has reached the position 34" and then lies at a distance a1 below the axis 28.

During this treatment the chain will be moved in the longitudinal direction thereof in that shaft 12 with the first supporting surface 16 and the wheel 42 with the second supporting surface 46 can rotate freely as a result of the presence of the bearings 8*a*-8*b*, 10*a*-10*b*, 40, when the shaft 12 is rotated.

The angle over which the shaft 28 is rotated determines the increase of the distance between the supporting surfaces 16 and 46 respectively and therewith the value of the tensile stresses which are generated in the chain 18.

Figure 3:
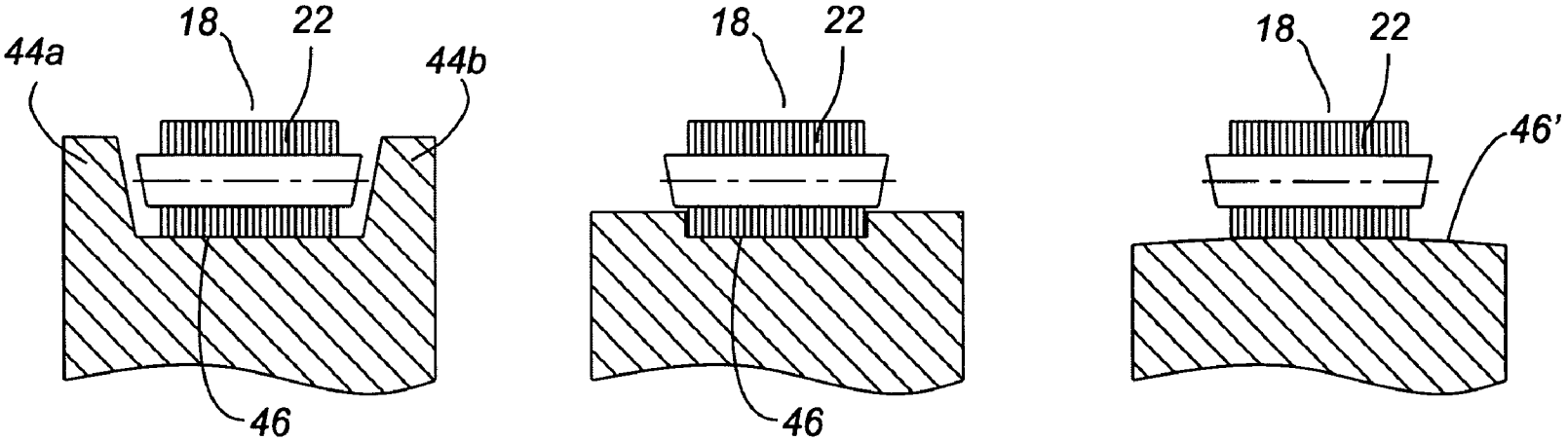
FIGS. 3*a*, 3*b*, 3*c* are examples of an embodiment of the supporting surface on which the links of a transmission chain bear during the stretching treatment.

FIG. 3 shows in the part drawings a, b and c three possible embodiments of the supporting surfaces 16 and 46 respectively. FIG. 3*a* shows on a greater scale the situation according to FIG. 2, thus the situation in which the supporting surface 46 is enclosed between the flanges 44*a*, 44*b* and the chain 18 which is to be treated rests with the lower edges of the links 22 on this supporting surface. FIG. 3*b* shows the situation in which the guiding flanges 44*a*, 44*b* are omitted and the circle-cylindrical supporting surface 46 is embedded, so that here, too, a guiding for the chain is obtained, while FIG. 3*c* shows how the supporting surface 46' has a convex shape so that here, too, the chain 18, of which the inner end edges of the links 22 rest upon this supporting surface 46', is centered. A combination of the various configurations for the respective supporting surfaces is also possible.

By giving the two cylindrical supports 16 and 46 respectively mutually different diameters—in which the diameter of the support 46 can be, for instance, 2-2½ times greater than the diameter of the support 16 the loading conditions of the chain, as encountered during operation in a Continuously Variable transmission can be simulated. Of course other diameter ratios can be used.

Figure 4:
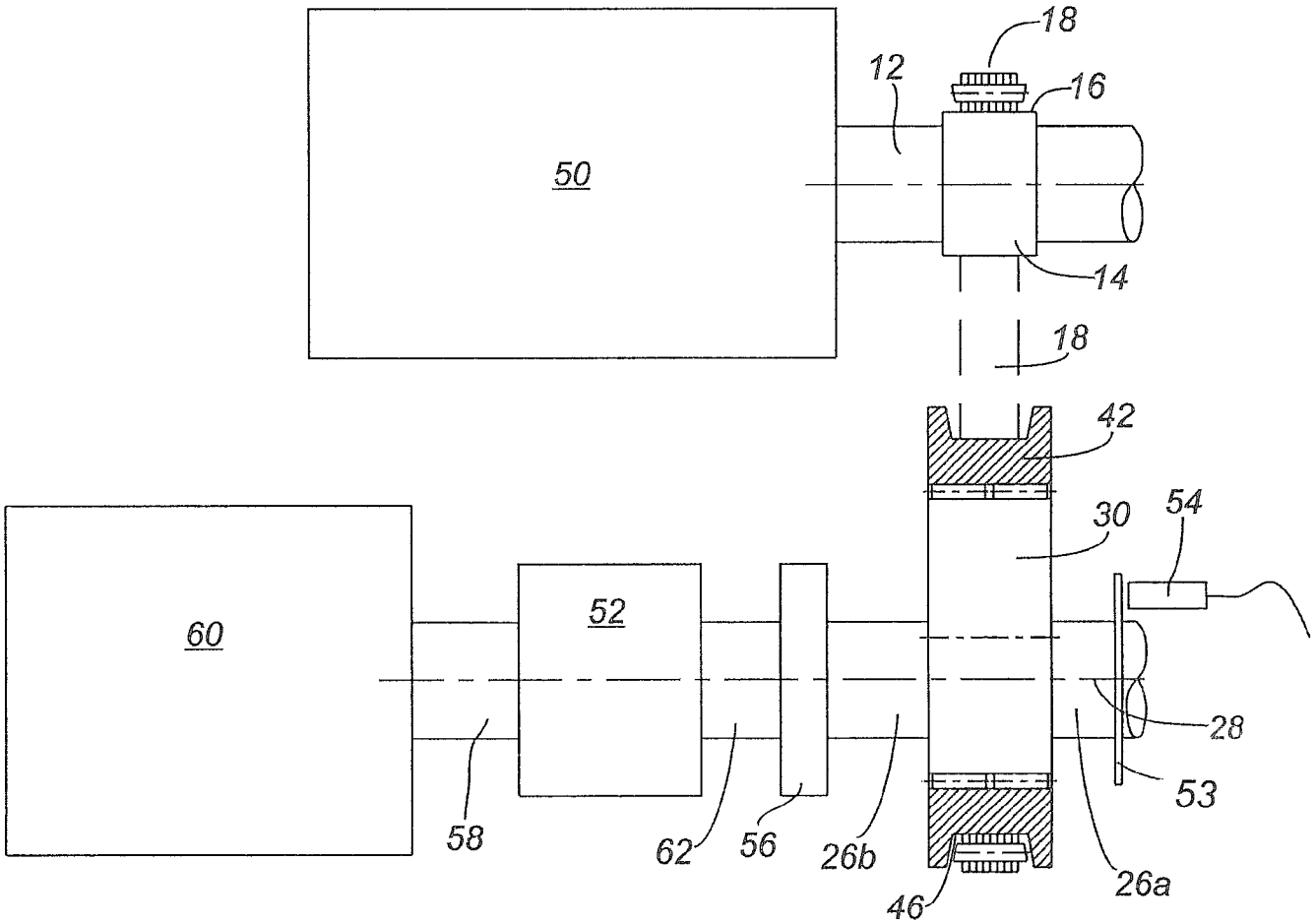
FIG. 4 is schematically an embodiment of a complete installation for an automated treatment of transmission chains using therein a device according to the FIGS. 1 and 2

FIG. 4 shows a complete installation for stretching transmission chains using the device according to the invention. The shaft 12 is coupled with a driving motor 50 to rotate this shaft with a predetermined rotational speed. The right hand stubby shaft 26*a* of the auxiliary carrier 30 carries a coding disk 53 which cooperates with the angle sensor 54 to supply an output signal which is a measure of the angular rotation around the axis 28 of the auxiliary carrier 30 while the left hand stubby shaft 26*b* is coupled with a torque meter 56 of which the ingoing shaft 62 is coupled with the outgoing shaft of a transmission 52 (for instance by means of a worm gear) and of said transmission the ingoing shaft 58 is coupled to the motor 60 which rotates the shaft 58.

The reduction gear 52 is used to reduce the very great torque exerted on the shaft 26 to the motor 60 and to allow for a more accurate angular positioning of the auxiliary carrier 30.

The whole operates as follows:

After the fitting of the chain 18 over the two supports 16 and 46 respectively the motor 60 rotates the auxiliary carrier 30 over such an angle around the axis 28 that the chain 18 is under a light pre-tension. Thereafter the motor 50 drives the shaft 12 such that, via the supporting surface 16, the chain is driving in its longitudinal direction. By means of the motor 60, the reduction gear 52 and the torque meter 56 the auxiliary carrier 30 is now rotated around its axis 28 in such a way that the distance between the supporting surfaces 16 and 46 increases and the wanted tensile stresses in the chain are generated. The torque detected by the torque meter 56 is a direct measure for the tensile stresses generated in the chain 18, and the angle of rotation of the auxiliary carrier 30 is a measure for the stretch of the chain.

By means of the coding disk 53 and the sensor 54 on the one hand and the output signal of the torque meter 56 on the other hand the relation between the angle of rotation of the shaft 28 and the tensile stress generated in the chain 18 can be determined. The data which is of importance for the process (the torque which represents the tensile stresses and the angle of rotation which represents the permanent stretch) can be stored in a known way.

It is observed that the rotation of the auxiliary carrier 30 over a certain angle can also be brought about by means of a tilting arm which is connected to one or to both the stubby shafts and of which the free end is driven by a suitable actuator.

The invention claimed is:

1. A device for stretching a continuous transmission chain having a number of adjacent links which are, as seen in the longitudinal direction of the chain, mutually coupled by pairs of elongated rocker elements, each rocker element having two ends, wherein for each pair of rocker elements, the ends of at least one rocker element cooperate in a torque transferring way with a pulley sheave of a pulley sheave transmission, comprising:

a first and a second supporting surface, each surface supporting a chain to be stretched over a part of an arc, wherein the distance between the first and second supporting surface is adjustable in such a way that in a chain which supported thereby, a tensile stress can be generated that locally exceeds a limit of elasticity of the material of the links, a frame having two arms which lie at a distance from each other, wherein the first supporting surface is freely rotatably accommodated between the arms at a first end of the frame, an auxiliary carrier accommodated between the two arms and supported by two stubby shafts, each protruding at a surface of the auxiliary carrier, wherein the second supporting surface is freely rotatable around the auxiliary carrier and an axis of rotation of the stubby shafts lies at a distance from an axis of rotation of said second supporting surface, said stubby shafts being rotatably supported between the arms near a second end of the frame while at least one of said shafts is coupled to the auxiliary carrier and can be driven in rotation therewith.

2. The device according to claim 1, wherein the supporting surfaces are such that they support a radial inner area of at least a part of the chain.

3. The device according to claim 1, wherein the supporting surfaces are conical surfaces on which the ends of the torque transmitting rocker elements can bear.

4. The device according to claim 1, wherein the diameter of the second supporting surface is at least 2-2½ times larger than the diameter of the first supporting surface.

5. The device according to claim 1, further comprising means for rotatably driving the first support.

6. The device according to claim 1, further comprising a torque meter accommodated in a drive for the auxiliary carrier.

7. The device according to claim 6, further comprising means to determine an angular position of the auxiliary carrier and for indicating a torque with which this carrier is driven as a function of the determined angular position.

8. The device according to claim 2, wherein the diameter of the second supporting surface is at least 2-2½ times larger than the diameter of the first supporting surface.

9. The device according to claim 2, further comprising means for rotatably driving the first support.

10. The device according to claim 2, further comprising a torque meter accommodated in a drive for the auxiliary carrier.

* * * * *